US005509636A

United States Patent [19]

Cotugno

[11] Patent Number: 5,509,636

[45] Date of Patent: Apr. 23, 1996

[54] RETAINER CLIP FOR REINFORCEMENT OF CONCRETE WALLS

[76] Inventor: Joseph A. Cotugno, 7360 Blacklick Eastern Rd., Pickerington, Ohio 43147

[21] Appl. No.: 396,349

[22] Filed: Feb. 28, 1995

Related U.S. Application Data

[63] Continuation of Ser. No. 112,310, Aug. 27, 1993, abandoned.

[51] Int. Cl.[6] ..... E04C 5/16

[52] U.S. Cl. ..... 249/91; 24/336; 24/339; 24/531; 52/665; 52/685; 52/686; 249/210; 249/213; 249/219.1; 403/385; 403/397; 403/395

[58] Field of Search ..... 249/91, 93, 94, 249/207, 210, 213, 218, 219.1; 52/665, 677, 685, 686, 698, 699, 700, 712, 714, 719; 24/336, 339, 531; 403/385, 388, 395, 397, 400

[56] References Cited

U.S. PATENT DOCUMENTS

| | | | |
|---|---|---|---|
| 1,072,361 | 9/1913 | Rickman | 52/699 |
| 1,126,190 | 1/1915 | Fuehrer | 249/218 |
| 1,144,093 | 6/1915 | Bandtel | 52/686 |
| 1,784,329 | 12/1930 | Bierhaalder | 249/213 |
| 2,064,705 | 12/1936 | Whitehead | 52/685 |
| 2,099,260 | 11/1937 | Colt | 249/213 |
| 3,004,370 | 10/1961 | Tinnerman | 52/719 |
| 3,359,019 | 12/1967 | Pinkney | 403/397 |
| 3,512,330 | 5/1970 | Shlesinger | 52/677 |
| 3,605,367 | 9/1971 | Crawley | 52/714 |
| 3,788,025 | 1/1974 | Holmes | 52/686 |
| 3,806,994 | 4/1974 | Lankford | 24/84 B |
| 4,110,951 | 9/1978 | Padrun | 52/686 |
| 4,405,112 | 9/1983 | Doubleday etal. | 249/207 |
| 4,575,985 | 3/1986 | Eckenrodt | 52/686 |
| 4,610,122 | 9/1986 | De Clereq | 52/719 |
| 4,803,825 | 2/1989 | Wheeler | 52/677 |
| 4,844,646 | 7/1989 | Wier | 403/24 |
| 4,936,540 | 6/1990 | Boeshart | 249/215 |
| 4,991,372 | 2/1991 | Sonneville | 52/685 |
| 5,042,219 | 8/1991 | Fricker | 52/707 |

FOREIGN PATENT DOCUMENTS

| | | | |
|---|---|---|---|
| 1484184 | 9/1977 | Germany | 52/685 |
| 1142886 | 2/1969 | United Kingdom | 52/685 |
| 1250021 | 10/1971 | United Kingdom | 52/685 |

OTHER PUBLICATIONS

Photocopies—Retainer for Intersecting Reinforcing Rods—Commercially Available.

*Primary Examiner*—James P. Mackey
*Attorney, Agent, or Firm*—C. M. Gegenheimer

[57] ABSTRACT

A retainer clip for use with concrete form tie for retention of reinforcing rods has a one-piece body which includes a header, and first and second clips extending angularly therefrom, spaced apart in a first direction, and defining therebetween a generally u-shaped opening sized to slidably receive a reinforcing rod of generally circular cross section. Each of the clips include first and second prongs spaced apart in directions lateral to the first direction, and at least two prongs of the clips further define therebetween a narrow generally rectangular passage which intersects at least a portion of the u-shaped opening, and is sized to receive at least a notched form tie of generally narrow rectangular cross section. The retainer clip secures the reinforcing rod in position substantially against the form tie in a notch to inhibit both relative motion in the first direction and substantial separation therebetween.

18 Claims, 3 Drawing Sheets

RETAINER CLIP FOR REINFORCEMENT OF CONCRETE WALLS

This is a continuation of application Ser. No. 08/112,310, filed Aug. 27, 1993, now abandoned.

BACKGROUND OF THE INVENTION

The present invention relates to reinforced concrete structures and, in particular, to a retainer clip for use with concrete form ties for retention of reinforcing rods.

The construction of reinforced concrete structures requires that reinforcing materials therein, such as reinforcing rod, be secured during pouring. Conventionally, reinforcing rod has been secured in place by tie wire. Typically, tie wire is applied manually in one of several configurations using both hands, and connects the reinforcing rod to other intersecting reinforcing rods or structures internal to the concrete structure to be poured.

Because of the labor costs involved, the lack of ready access to some locations, and the possibility of injury to workers due to the wire or the location, numerous specially configured devices have been developed for specific tasks relating to concrete construction. For example, to position reinforcing rods relative to forms, various chair devices support reinforcing rods above bottom forms used to produce horizontal floor slabs. Form ties, were developed to separate opposing forms defining vertical wall slabs, and have long included notches in their upper edges to further support and partially restrain reinforcing rods positioned therein.

Where notched form ties are used to produce vertical slabs, reinforcing rods placed thereon are either secured by tie wire, or remain only partially restrained against lateral movement by the edges of the notches. Because the access between vertical forms to secure rods with tie wire is typically limited, the labor cost and risks to workmen are increased when securing rods to form ties with tie wire. Left unsecured, however, reinforcing rods may dislodge from the notches when concrete is being poured, producing an inferior result.

Accordingly, the need exists for further improvements in devices which both space and secure reinforcing rods positioned on notched form ties used in concrete construction.

SUMMARY OF THE INVENTION

The present invention satisfies that need by providing a retainer clip for notched form ties which inhibits separation of reinforcing rod from its location in a notch of the form tie. The retainer clip of the present invention eliminates the need for tie wire, and its one-piece construction makes it easy to use with one hand in a fraction of the time required to wire reinforcing rod to a form tie, thus reducing labor costs.

In accordance with the present invention, a retainer clip is provided having a one-piece body which includes a header, and first and second clips extending angularly therefrom. The clips are spaced apart in a first direction, and define therebetween a generally u-shaped opening sized to slidably receive a reinforcing rod of generally circular cross section. Each of the clips include first and second prongs spaced apart in directions lateral to the first direction. At least two prongs of the clips further define therebetween a narrow generally rectangular passage through the clips generally in the first direction. The passage intersects at least a portion of the u-shaped opening, and is sized to receive at least a notched form tie of generally narrow rectangular cross section.

Each of the clips further includes at least one flexible prong to facilitate receipt of a notched form tie in the narrow generally rectangular passage when a tie is slidably inserted towards the header from the opposite ends of the prongs. Each of the clips still further has at least one prong with a catch positioned such that the first and second clips will releasably engage a narrow generally rectangular notched form tie received in the narrow generally rectangular passage when a reinforcing rod is positioned in a notch of the form tie and received in the u-shaped opening between the form tie and the header.

The retainer clip structure of the present invention, thus, achieves the fairly specific result of securing the reinforcing rod in position in a notch substantially against form ties of the type widely used for many years in concrete construction, and thereby inhibits both relative motion in the first direction and substantial separation between the rod and the notched form tie. As well, the retainer clip may be used to hold reinforcing rod to a form tie when the form tie is used in any position. Moreover, while providing positive restraint of the reinforcing rod, the retainer clip may be inserted easily with one hand and a minimal expenditure of labor, yet is releasable to permit readjustment or repositioning of the reinforcing rod without time-consuming disassembly.

These and other advantages and features of the present invention will be apparent from the drawings and detailed description which follow.

DETAILED DESCRIPTION OF THE PREFERRED EMBODIMENTS

Figure 1:
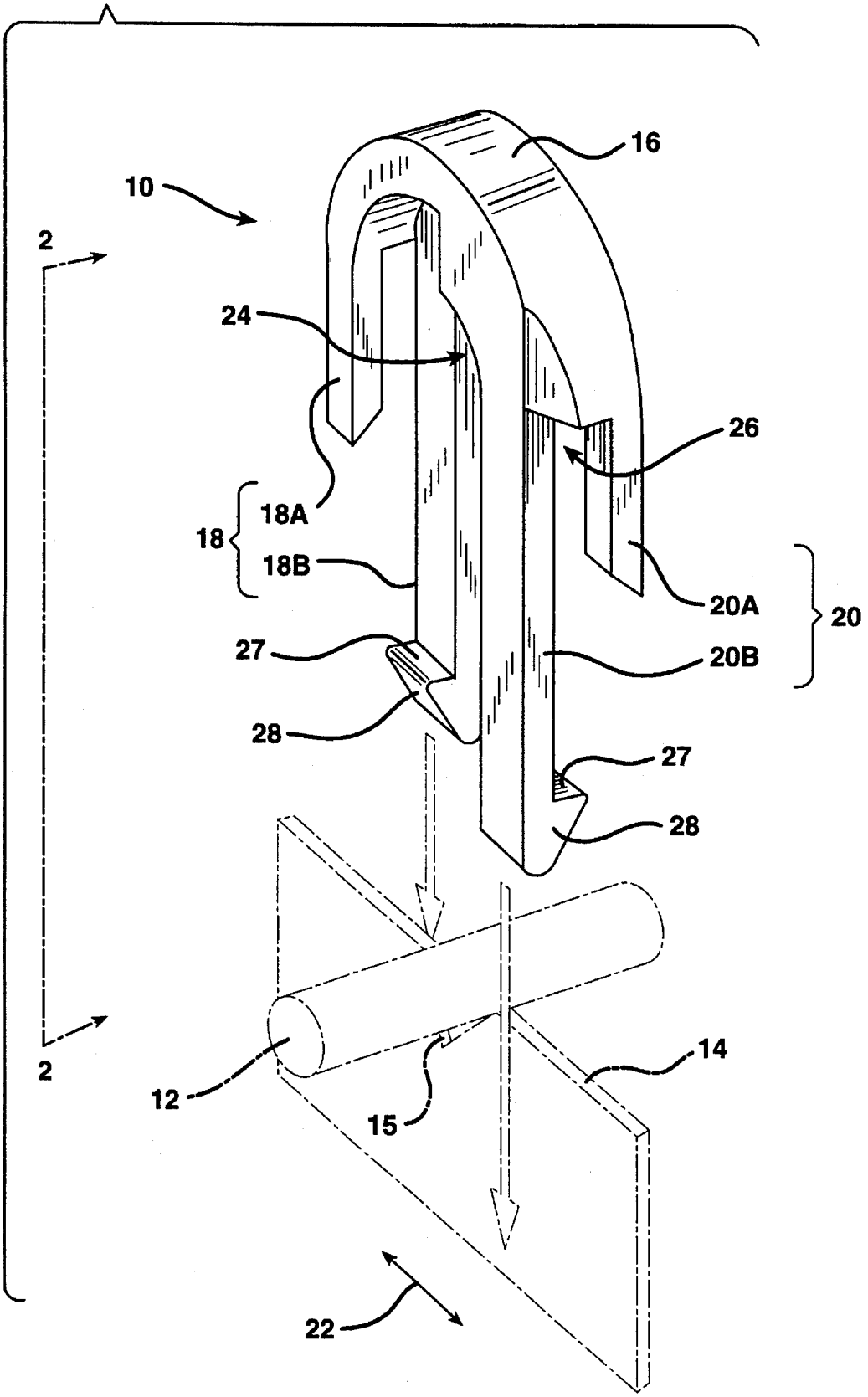
FIG. 1 is a schematic perspective view of the preferred embodiment of the present invention.
Figure 2:
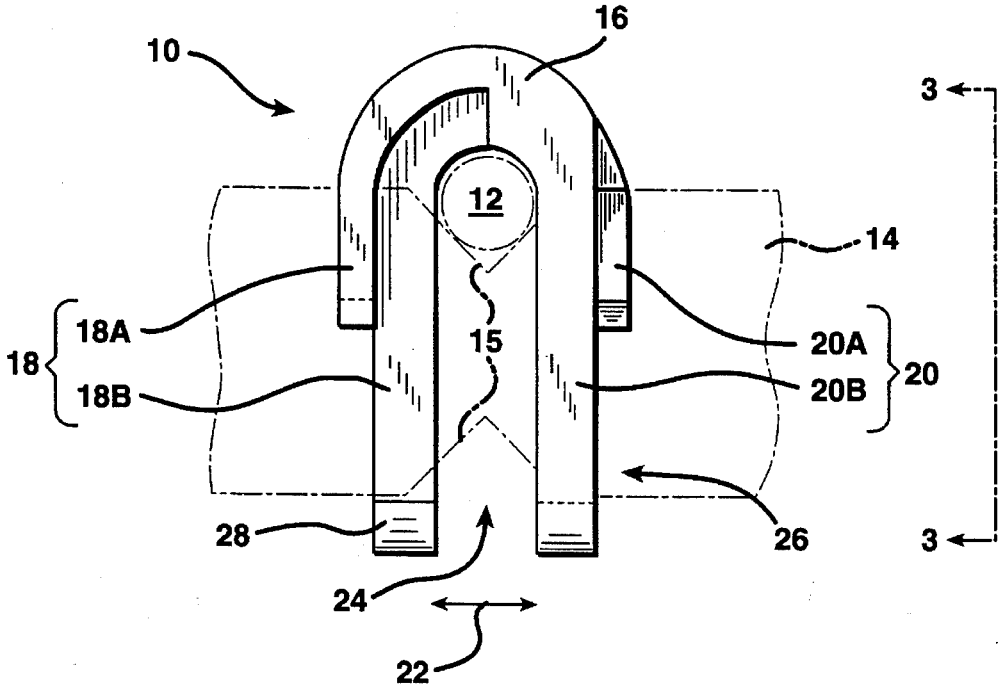
FIG. 2 is a schematic front view of the preferred embodiment of FIG. 1 taken along line 2—2.
Figure 3:
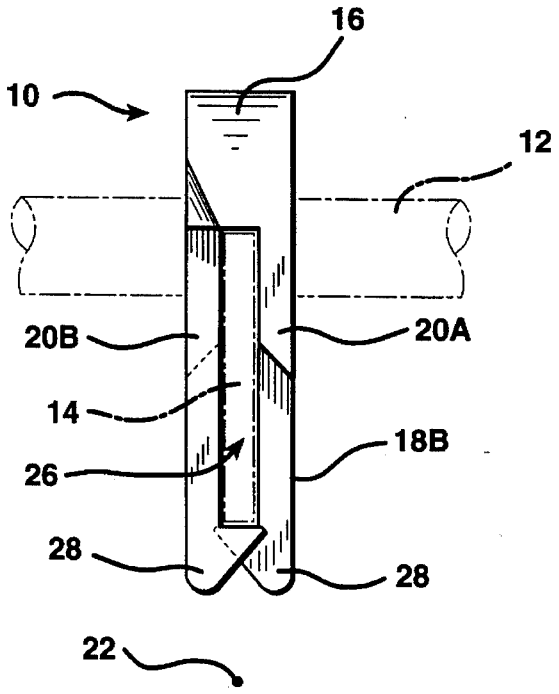
FIG. 3 is a schematic side view of the preferred embodiment of FIG. 2 taken along line 3—3.

Referring to FIGS. 1–3, in accordance with the present invention, the preferred retainer clip 10 for restraining reinforcing rod 12 (shown in phantom) on a notched form tie 14 (also shown in phantom) is illustrated. The retainer clip 10 has a one-piece body which includes a header 16, and first and second clips 18, 20 extending angularly therefrom. The clips 18, 20 are spaced apart in a first direction, indicated by arrow 22 in FIG. 2, and define therebetween a generally u-shaped opening 24 sized to slidably receive a reinforcing rod 12 of generally circular cross section. Shown best in FIG. 1, each of the clips 18, 20 includes first and second prongs 18A, 18B and 20A, 20B, respectively, spaced apart in directions lateral, although not necessarily perpendicular, to the first direction 22. Preferably, the prongs 18A and 18B, and 20A and 20B, in clips 18, 20, respectively, are in offset relationship. At least two prongs of the clips 18, 20 further define therebetween a narrow generally rectangular passage 26, shown best in FIG. 3. As may be understood from FIGS. 1–3, the passage 26 extends generally in the first direction 22 through the clips 18, 20, intersects at least a portion of the u-shaped opening 24, and is sized to receive at least a notched form tie 14 of generally narrow rectangular cross section.

Each of the clips 18, 20 further include at least one flexible prong which can deflect to facilitate receipt of a notched form tie 14 in the narrow generally rectangular passage 26 by slidably inserting the form tie towards the header from the opposite ends of the prongs, as illustrated in FIG. 1. Each of the clips 18, 20 still further has at least one prong with a catch 28 positioned such that the clips 18, 20 will releasably engage a narrow generally rectangular notched form tie 14 received in the narrow generally rectangular passage 26 when a reinforcing rod 12 is positioned in a notch 15 of the form tie 14 and received in the u-shaped opening 24 between the form tie 14 and the header 16.

This structure permits the retainer clip 10 to secure the reinforcing rod 12 in position in a notch 15 substantially against form tie 14 to inhibit both relative motion in the first direction 22 and substantial separation between the rod 12 and the notched form tie 14. Moreover, the retainer clip 10 of the present invention eliminates the time and labor required to so secure such rods, resulting in significant construction cost savings. As well, the retainer clip 10 is also releasable to permit readjustment or repositioning of the reinforcing rod 12 without time-consuming disassembly. Preferably, there remains sufficient play between the retainer clip 10, reinforcing rod 12, and form tie 14 to enable the user to slide the reinforcing rod 12 longitudinally for adjustment thereof without removing the retainer clip 10.

As shown in the preferred embodiment of FIGS. 1–3, preferably the header 16 has a curved generally semicircular shape defining the closed end of the u-shaped opening, and the first and second clips 18, 20 preferably extend therefrom in generally parallel relationship. So configured, the header 16 defines one narrow side of the narrow generally rectangular passage 26. As further shown, it is preferred that the first and second prongs be different lengths, and that regardless of length, that the ends of the prongs be beveled, to facilitate insertion of the notched form tie 14 therebetween.

As shown in FIGS. 1 and 3, it is preferred that two prongs, one prong from each of the clips 18, 20, define the narrow generally rectangular passage 26. As shown, the two prongs are positioned to define opposite sides of the narrow generally rectangular passage 26, and each includes a catch 28. The catches, spaced from the header 16, together define one narrow side of the passage 26, and are preferably positioned near the prong ends which are opposite the header 16. A portion of the catches 16 releasably engage that edge of the form tie 14 which is farthest from the header 16.

As understood best from FIG. 1, the beveled ends of the prongs further serve to produce the preferred, wedge-shaped catch 26 extending at an outward angle from the tip of the prong to a flat portion 27. The flat portion 27 generally faces the header 16 and has sufficient size to engage the form tie 14 as just described. It is understood that some flexibility in at least one prong of each clip 18, 20 is necessary to permit insertion of the form tie 14 in the passage 26. In this regard, the feature of flexibility may advantageously be provided on the same prong as are the catches 26.

As may be understood best from FIG. 3, the u-shaped opening 24 may be defined to extend further into the header 16 than the narrow generally rectangular passage 26. That is, even when the reinforcing rod 12 is positioned in a notch 15, a portion of the rod 12 extends out beyond the notched edge of the form tie 14. Defining the u-shaped opening 24 further into the header 16 serves to provide additional stability to the retainer clip 10 by resting portions thereof on the edge of the form tie 14, and by nesting the reinforcing rod 14 to increase its surface contact with the retainer clip 10.

Figure 4:
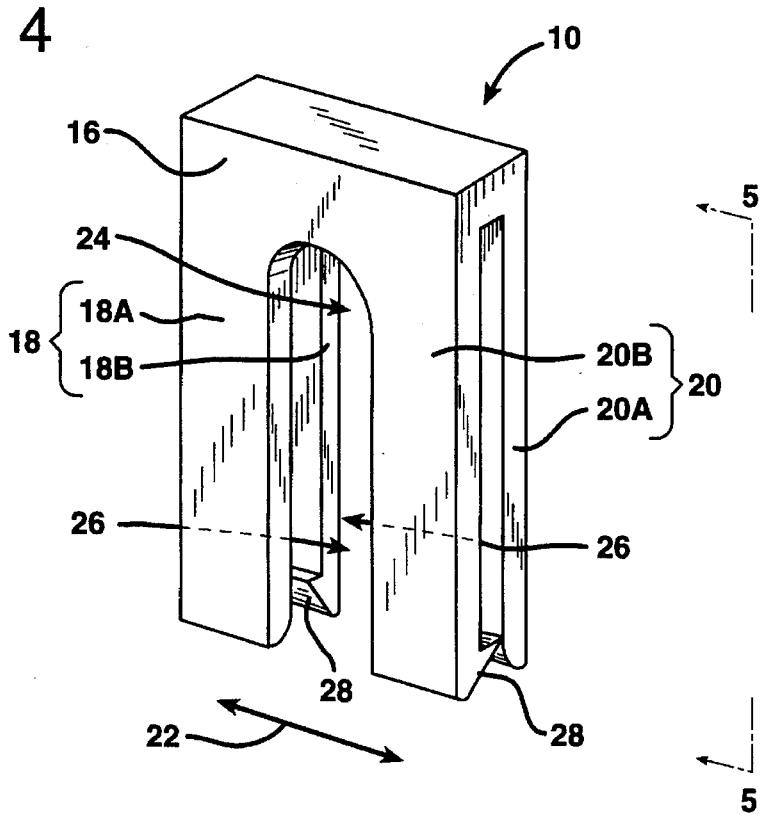
FIG. 4 is a schematic perspective view of an alternative embodiment of the present invention.
Figure 5:
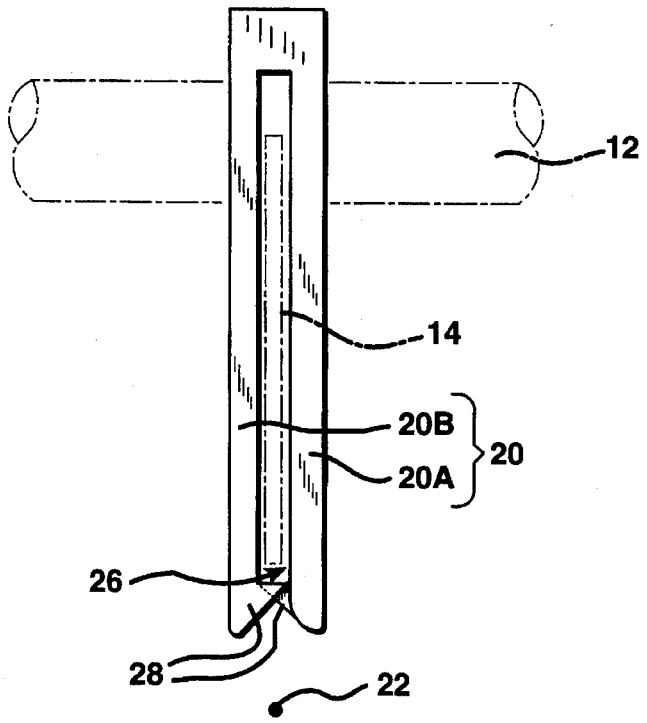
FIG. 5 is a schematic side view of the alternative embodiment of FIG. 4 taken along line 5—5.

Referring now to FIGS. 4 and 5, an alternative embodiment of the retainer clips 10 of the present invention are shown wherein each of the clips 18, 20 includes first and second prongs 18A, 18B and 20A and 20B, respectively, of substantially equal length. In the alternative embodiment, the prongs are shown in opposing, rather than offset, relationship. The alternate embodiment also shows the catches 28 on ones of the prongs defining opposite sides of the narrow generally rectangular passage 26. It is understood that the catches may be on the same side, however, where the opposing prongs 18A and 18B, and 20A and 20B, are generally the same length. As well, it is preferred in the alternative embodiment that all of the prongs are flexible, for ease of use. FIG. 5 illustrates that the u-shaped opening 24 and passage 26 may extend the same distance into the header 16 in accordance with the present invention.

Generally, in accordance with the present invention, the width of the u-shaped opening 24 provided may vary with the width of reinforcing rod 12 to be used. As well, the width of the narrow generally rectangular passage 26 can vary with the size of the form tie 14. Typically, the ratio between the width of the generally u-shaped opening 24, and the width of the narrow generally rectangular opening 26 will be greater than or equal to 2:1. For example, where a ½ inch diameter reinforcing rod and a notched form tie 1/16 inches wide by 1½ inches high having 5/16 inch deep notches are used, the ratio may be 5:1, with the u-shaped opening 24 having a width of approximately ⅝ inches and the passage having a width of approximately ⅛ inches. However, these ratios are illustrative, and not intended to limit the present invention in its broad application to securing reinforcing rod 12 to notched form ties 14 to prevent relative motion in the first direction 22 or substantial separation therebetween. Thus, it is contemplated that a series of retainer clips 10 for different sizes of reinforcing rod 12 and different sizes of narrow, generally rectangular, notched form ties 14 fall within the scope of the present invention.

Further, in accordance with the present invention it is preferred that the retainer clip 10 be a one-piece plastic body. By way of example and not limitation, the plastic preferably includes acrylonitrile-butadiene-styrene (ABS).

Finally, it is understood from FIGS. 1–5 that the retainer clip 10 holds the reinforcing rod 12 in position against unintended displacement by straddling, and engaging an edge of, a notched form tie 14, thereby trapping the reinforcing rod 12 in a notch 15 between the form tie 14 and the header 16. With suitable material strength in the body and catches 28, the retainer clip 10 is thereby able to trap and securely hold a reinforcing rod 12 either above (as shown in FIGS. 2,3 and 5), below a notched form tie 14 suspended by the catches 28, or any other position.

While certain representative embodiments and details have been shown for purposes of illustrating the invention, it will be apparent to those skilled in the art that various changes in the device shown herein may be made without departing from the scope of the invention, which is defined in the appended claims.

What is claimed is:

1. A retainer clip assembly for retention of a reinforcing rod comprising a retainer clip and a notched form tie which has a generally rectangular cross section and a notch, said retainer clip comprising a one-piece body having:

a header; and first and second clips extending angularly from the header to clip ends, said clips spaced apart in a first direction, and defining therebetween a generally u-shaped opening sized to slidably receive a reinforcing rod extending lengthwise in a second direction lateral to said first direction and having a generally circular cross section; and wherein each of said clips further comprises first and second prongs spaced apart in said second direction, at least two prongs of said clips further defining therebetween a narrow generally rectangular passage extending generally through the clips in the first direction, said passage intersecting at least a portion of said u-shaped opening and sized to receive and confine said notched form tie extending lengthwise in said first direction; and wherein in each of said clips:

at least one of said prongs has flexibility to deflect and facilitate receipt of said notched form tie in said narrow generally rectangular passage by slidably inserting the form tie towards said header between the ends of said clips; and at least one of said prongs has a catch positioned such that said clips confine said narrow generally rectangular notched form tie received in the narrow generally rectangular passage; and wherein, without clamping, said reinforcing rod and said form tie are restrained against substantial separation from each other, and, without clamping, said form tie is restrained against relative motion in the first direction when said reinforcing rod is received in said u-shaped opening between said notch in said form tie and said header.

2. The retainer clip assembly of claim 1 wherein said header has a curved generally semi-circular shape defining the closed end of said u-shaped opening.

3. The retainer clip assembly of claim 1 wherein said u-shaped opening extends further into said header than does said narrow generally rectangular passage.

4. The retainer clip assembly of claim 1 wherein said first and second clips extend in generally parallel relationship.

5. The retainer clip of claim 1 wherein two prongs define the narrow generally rectangular passage, and said two prongs include one prong from each of said clips wherein:

said two prongs are positioned to define opposite sides of said narrow generally rectangular passage; and said two prongs each include said catch spaced from said header and positioned to define together one narrow side of said narrow generally rectangular passage.

6. The retainer clip assembly of claim 5 wherein said header defines one narrow side of said narrow generally rectangular passage.

7. The retainer clip assembly of claim 1 wherein at least one of said clips includes first and second prongs of different lengths.

8. The retainer clip assembly of claim 1 wherein each of said clips includes first and second prongs of substantially equal length.

9. The retainer clip assembly of claim 1 wherein said flexibility and said catch are combined together in at least one prong of at least one of said clips.

10. The retainer clip assembly of claim 1 wherein said prongs having a catch include said catch positioned thereon near the ends of said clips.

11. The retainer clip assembly of claim 10 wherein said clips releasably confine said narrow generally rectangular notched form tie with a portion of said catches.

12. The retainer clip assembly of claim 1 wherein a portion of an end of at least one of said clips is beveled.

13. The retainer clip assembly of claim 1 wherein each said catch comprises a wedge shape extending at an outward angle from said end of said clip to a flat portion generally facing said header having sufficient size to define a portion of said passage and confine said narrow generally rectangular form tie.

14. The retainer clip assembly of claim 1 wherein the ratio between the width of said generally u-shaped opening defined by the first and second clips, and the width of said narrow generally rectangular passage defined by the at least two prongs is greater than or equal to 2:1.

15. The retainer clip assembly of claim 1 wherein the one-piece body is comprised of plastic.

16. The retainer clip assembly of claim 15 wherein the plastic includes acrylonitrile-butadiene-styrene.

17. A retainer clip assembly for retention of a reinforcing rod comprising a retainer clip and a notched form tie which has a generally rectangular cross section and a notch said retainer clip comprising a one-piece body having:

a header; and first and second clips extending angularly from the header, spaced apart in a first direction, and defining therebetween a generally u-shaped opening sized to slidably receive a reinforcing rod of generally circular cross section; and wherein each of said clips further comprises first and second prongs of different lengths spaced apart in directions lateral to said first direction, at least two prongs of said clips further defining therebetween a narrow generally rectangular passage extending generally through the clips in the first direction, said passage intersecting at least a portion of said u-shaped opening and sized to receive at least said notched form tie;

wherein said u-shaped opening extends further into said header than does said narrow generally rectangular passage; and wherein at least one of said first and second prongs of each said clip is flexible; and wherein at least one of said first and second prongs of each said clip has a catch positioned in spaced relationship from said header to releasably confine said form tie received in the narrow generally rectangular passage when said reinforcing rod is positioned in said notch of the form tie and received in said u-shaped opening between the form tie and said header;

wherein, without clamping, the retainer clip assembly secures said reinforcing rod in position substantially against the form tie to inhibit both relative motion of the form tie in the first direction and substantial separation between the reinforcing rod and retainer clip assembly.

18. A retainer clip assembly for retention of a reinforcing rod comprising a retainer clip and a notched form tie which has a generally rectangular cross section and a notch said retainer clip comprising a one-piece body having:

a header;

first and second clips extending angularly from the header to clip ends, said clips in generally parallel relationship, spaced apart in a first direction, and defining therebetween a generally u-shaped opening sized to slidably receive a reinforcing rod of generally circular cross section, said header having a semicircular portion defining the closed end of said u-shaped opening; and wherein each of said clips further comprises first and second prongs spaced apart in directions lateral to said first direction, at least two prongs of said clips further defining therebetween a narrow generally rectangular passage extending generally through the clips in the first direction, said passage intersecting at least a portion of said u-shaped opening and sized to receive said notched form tie;

wherein the ratio between the width of said generally u-shaped opening defined by the first and second clips, and the width of said narrow generally rectangular passage defined by the at least two prongs is greater than or equal to 2:1;

wherein the end of at least one of said clips opposite the header is beveled; and wherein in each of said clips:

at least one of said prongs has flexibility to deflect and facilitate receipt of said notched form tie in said narrow generally rectangular passage by slidably inserting the form tie towards said header between said ends of said clips; and at least one of said clips has a catch positioned near the end thereof opposite said header such that said clips releasably confine said generally rectangular notched form tie received in the narrow generally rectangular passage when said reinforcing rod is positioned in a notch of the form tie and received in said u-shaped opening between the form tie and said header;

wherein, without clamping, in said retainer clip assembly the retainer clip secures said reinforcing rod in position substantially against the form tie to inhibit both relative motion in the first direction and substantial separation between said reinforcing rod and said form tie.

* * * * *